US006971253B2

(12) United States Patent
Matsuda et al.

(10) Patent No.: US 6,971,253 B2
(45) Date of Patent: Dec. 6, 2005

(54) KNITTED SLIDE FASTENER

(75) Inventors: Yoshio Matsuda, Toyama-ken (JP); Hidenobu Kato, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/055,423

(22) Filed: Feb. 10, 2005

(65) Prior Publication Data

US 2005/0178161 A1 Aug. 18, 2005

(30) Foreign Application Priority Data

Feb. 17, 2004 (JP) ..... 2004-039394

(51) Int. Cl.[7] ..... D04B 21/20
(52) U.S. Cl. ..... 66/193; 66/195
(58) Field of Search ..... 66/190, 191, 192, 66/193, 195; 24/391–393

(56) References Cited

U.S. PATENT DOCUMENTS

| | | | | |
|---|---|---|---|---|
| 5,540,064 | A * | 7/1996 | Matsuda et al. | 66/193 |
| 5,615,563 | A * | 4/1997 | Matsuda et al. | 66/193 |
| 5,685,177 | A * | 11/1997 | Matsuda et al. | 66/193 |
| 5,794,460 | A * | 8/1998 | Matsuda et al. | 66/193 |
| 5,857,359 | A * | 1/1999 | Matsuda et al. | 66/193 |
| 5,924,311 | A * | 7/1999 | Matsuda et al. | 66/85 R |
| 6,006,552 | A * | 12/1999 | Matsuda et al. | 66/193 |
| 6,148,643 | A * | 11/2000 | Matsuda et al. | 66/193 |

FOREIGN PATENT DOCUMENTS

| | | |
|---|---|---|
| EP | 0688514 A2 | 12/1995 |
| EP | 0741980 A2 | 11/1996 |
| EP | 0743025 A2 | 11/1996 |
| EP | 0925736 A2 | 6/1999 |
| JP | 3396335 | 2/2003 |
| JP | 3398828 | 2/2003 |
| JP | 3407162 | 3/2003 |
| JP | 3407165 | 3/2003 |

* cited by examiner

*Primary Examiner*—Danny Worrell
(74) *Attorney, Agent, or Firm*—Everest Intellectual Property Law Group

(57) ABSTRACT

This invention provides a knitted slide fastener, wherein at least a part of a base structure composing respective wales (W11 to W13) of a fastener element attaching portion (EF) of a fastener tape includes a ground chain knitting yarn composed of a single structure, and a partial needle loop of a fixing chain knitting yarn composes a double base structure while being interlaced only with the needle loop of the ground chain knitting yarn of the second wale (W12), the partial needle loop of a fixing chain knitting yarn to be formed on at least the second wale (W12) at a second row from the side nearest to a coupling head portion (EH) of the fastener element attaching portion (EF) among the three or more fixing chain knitting yarns of the fastener element attaching portion (EF), the knitted slide fastener being organized at a high speed with few kinds of stitches without an excess load on a needle, an element being solidly fixed.

8 Claims, 8 Drawing Sheets

KNITTED SLIDE FASTENER

BACKGROUND OF THE INVENTION

1. Field of the Invention

The present invention relates to a knitted slide fastener, in which a continuous fastener element row is knitted and attached to a fastener element attaching portion at a longitudinal side edge portion of a fastener tape to be organized by a double structure at the same time of organization of the fastener tape by using a double warp knitting machine having two rows of needle beds.

2. Description of the Related Art

Conventionally, many knitted slide fasteners have been proposed, in which a continuous fastener element row is knitted and attached to a fastener element attaching portion at a longitudinal side edge portion of a fastener tape at the same time of organization of the fastener tape by using a double warp knitting machine having two rows of needle beds. Most of them are proposed by an applicant of the present application, and for example, they are disclosed in Japanese Patent Publication No. 3396335, Japanese Patent Publication No. 3398828, Japanese Patent Publication No. 3407162, Japanese Patent Publication No. 3407165 and the like. In these patent Publications except for, Japanese Patent Publication No. 3398828, an example such that a fastener element attaching portion is configured by not a double structure but a single structure is also disclosed.

According to the double structure of the Japanese Patent Publication No. 3396335, a high quality slide fastener is obtained, in which a fastener element row is stably and solidly fixed in measurement to a fastener element attaching portion by making a line size of a fixing chain knitting yarn of a plurality fixing chain knitting yarns near a fastener element coupling head of the fastener element row larger than that of other fixing chain knitting yarns, the attaching posture is balanced to maintain a function as a fastener sufficiently, and even if a strong force acts on the slide fastener upon using it, a coupling crack of the fastener element row can be prevented.

In addition, the slide fastener according to Japanese Patent Publication No. 3398828 is organized in such a manner that a fixing chain knitting yarn is knitted to a fastener element attaching portion of a fastener tape by a double structure, a needle loop organized and continued in a longitudinal direction of an upper side of the fixing chain knitting yarn presses a leg portion of a continuous fastener element row, and a needle loop organized and continued in the longitudinal direction of a lower side of the fixing chain knitting yarn is interlaced with a knitting yarn of a base structure on which the continuous fastener element row is mounted.

According to such a configuration, the organization structure of the fastener element attaching portion is made dense to have small elasticity, so that the continuous fastener element row can be stably fixed in measurement. Further, according to such a configuration, when a tricot structure organized by interlacing two fixing chain knitting yarns with each other on the upper surface of the continuous fastener element row, the chain knitting structure for fixture does not oscillate in a lateral direction, so that it is possible to fix the continuous fastener element row to the fastener element attaching portion with a stable posture. Thus, since the fastener element row can be stably and solidly fixed to the fastener element attaching portion in measurement, a smooth coupling becomes possible.

According to the Japanese Patent Publication No. 3407162, a plurality of fixing chain knitting yarns to press the leg portion of the continuous fastener element row are knitted to the fastener element attaching portion of the fastener tape, and a weft in-laid yarn for fixture is horizontally put in a zigzag manner between the plural parallel fixing chain knitting yarns to be crossed and arranged there. As a result, elasticity in a warp direction of the fastener element row is prevented, so that there is little irregularity of a pitch, and appropriate resistance force is given to bending of a fastener surface to prevent the engagement crack and secure the smooth operation of the slide fastener.

In addition, the knitted slide fastener according to the Japanese Patent Publication No. 3407165, a chain stitch is organized at the furthest external side end edge of the fastener element attaching portion, and plural weft in-laid yarns are interlaced and reversed in this chain stitch individually and alternatively so as to organize a base structure of the fastener element attaching portion. According to such a structure, particularly, according to the weft in-laid yarn, a waving state due to roughness and density of the base structure of the fastener element attaching portion is corrected, so that the base structure is integrated, the knitting yarn is prevented to protrude from the end locally, and sliding movement of the slider can be smoothly carried out. Further, since the fastener element row is fixed to the fastener element attaching portion by organizing a plurality of fixing chain knitting yarns into a double structure, this fastener element attaching portion has an excellent advantage such that the strong attachment is possible as same as the fastener element attaching portion that a plurality of fixing chain knitting yarns are organized into a single structure.

Generally, when organizing a fastener tape by using a double knitting warp machine having two rows of needle beds, not only the double structure and the single structure are mixed, but also various kinds of yarns such as a double chain knitting yarn, a single chain knitting yarn, a tricot knitting yarn, and a two needle stitch knitting yarn are interlaced with each other to make a stitch by one needle. Accordingly, particularly, a load on a needle when fastening and fixing a continuous element row made of a mono filament by a fixing knitting yarn is increased largely. Therefore, a folding loss of a needle and skip of a stitch of each knitting yarn are frequently generated and this makes very difficult to organize the fastener tape at a high speed.

In the meantime, any of the knitted slide fastener disclosed in the above-described four patent publications includes a case that the double structure is organized by the fixing chain knitting yarn and the tricot knitting yarn on the base structure of its fastener element attaching portion. Therefore, in addition to the above-described object, due to the tricot knitting yarn, elasticity may easily occur in a wale direction at the fastener element attaching portion organized by the double structure described in the above-described four patent publications. In addition, for example, as represented by the Japanese Patent Publication No. 3398828, the same elements are fastened and fixed for each two courses with the leg portion of the fastener element made of a mono filament put between sinker loops to be formed adjacent between one needle loop of the double knitting yarn for fixing the element and a needle loop of the single knitting yarn. Accordingly, it is not possible to prevent elasticity of a fastener chain in a longitudinal direction. As compared to the case that the continuous fastener element row is attached to a woven tape by a sawing machine, a lateral pulling tension, a bending tension, and a thrust tension of the fastener chain are inferior.

For example, as the knitted slide fastener of the Japanese Patent Publication No. 3407162, in the case of pressing the leg portion of the element by the weft in-laid yarn arranged in a zigzag manner on the fastener element attaching portion together with the fixing chain knitting yarn, a degree of coating by the yarn to the element is increased, and the element can be fixed solidly, so that the extension of the fastener chain can be prevented. However, a wale is pulled by the weft in-laid yarn so that fixation of the side of the coupling head comes loose, and it is highly feared that engagement crack is generated upon folding the fastener. In addition, for example as the knitted slide fastener according to the Japanese Patent Publication No. 3396335, in the case of solidly fixing the leg portion at the side of the head by the double chain knitting yarn for fixing the element, the knitting yarn is reinforced and the coupling strength is increased, on the contrary, the movement of the element upon opening and closing the fastener becomes too small and the sliding operation of the slider tends to get heavy.

The present invention has been made taking the foregoing problems into consideration and specifically, an object of which is to provide a knitted slide fastener, which can be organized at a high speed with few kinds of stitches and without an excess load on a needle; solidly fixes an element and prevents the extension of a fastener element attaching portion; and has no engagement crack of a fastener chain upon folding the fastener and has light sliding operation of a slider.

SUMMARY OF THE INVENTION

The above-described object is attained by a knitted slide fastener having a base structure composed of a double structure of a warp knitting, in which a continuous fastener element row (ER) is knitted in a fastener element attaching portion (EF) formed at one side edge portion of a fastener tape at the same time of organization of the fastener tape, being characterized in that three or more fixing chain knitting yarns are knitted in the fastener element attaching portion (EF) as a constitutional knitting yarn of the double structure; a needle loop at a part of each of the fixing chain knitting yarns presses a leg portion of each fastener element (E) while straddling the leg portion; a needle loop other than the needle loop is interlaced with a needle loop of a ground knitting yarn composing a part of the base structure on which the continuous fastener element row (ER) is mounted; at least a part of the base structure composing respective wales (W11 to W13) of the fastener element attaching portion (EF) includes a ground chain knitting yarn composed of a single structure; and a partial needle loop of the fixing chain knitting yarn composes a double base structure while being interlaced only with the needle loop of the ground chain knitting yarn of the second wale (W12), the partial needle loop of the fixing chain knitting yarn being formed on at least the second wale (W12) adjacent to the inside of the first wale (W13) including the fixing chain knitting yarn that is arranged at the furthest external side of the fastener element attaching portion (EF) among the three or more fixing chain knitting yarns.

In the knitted slide fastener according to the present invention, three or more fixing chain knitting yarns are knitted in the fastener element attaching portion as a constitutional knitting yarn of the double structure. A base structure is configured in such a manner that at least one of its needled loops presses the leg portion of each fastener element from above while straddling the leg portion, and other needle loops of the double structure are interlaced with each ground chain knitting yarn of the base structure to configure three or more wales including first and second wales of the fastener element attaching portion. In this case, according to the preferable embodiment, respective wales are coupled with each other by a plurality of weft in-laid yarns.

Accordingly, at the fastener element attaching portion, one needle loop of the fixing chain knitting yarn made of the double structure is arranged on the upper surface of the element where the fastener element is fixed and the other needle loops are interlaced with the needle loop of the ground chain knitting yarn of the single structure configuring a wale of the corresponding base structure via a sinker loop. Therefore, the needle loops are arranged on the upper and lower surfaces of the fastener element, respectively, and further, each fastener element is pressed between the sinker loops to be fastened and fixed. As a result, extension in a longitudinal direction of the fastener element attaching portion is prevented moderately, the strength of fixture is increased, and further, the surface of the fastener element is soft so that the slidability of the slider is also improved.

In addition, in the fastener element attaching portion according to the present invention, both of the double structure and the single structure are organized by the chain knitting structure, and further, other than the weft in-laid yarn, two and more knitting yarns are not interlaced in each needle. Therefore, even if a load is given to the needle when the fastener element is pressed and strongly pulled by the knitting yarn of the double structure, there is no excess load on the needle and the folding loss and the skip of the stitch are not generated. Since the double knitting yarn and the single knitting yarn are organized by the same chain knitting structure, no excess movement is needed in the knitting machine and the operation of the knitting machine at a high speed can be realized.

Preferably, the fixing chain knitting yarn of the second wale (W12) is composed of a knitting yarn that is thicker than the other fixing chain knitting yarns.

Consequently, differently from the case that the side of the coupling head is solidly fixed by two different knitting yarns for fixture as the conventional case, the fixture strength is secured, and the movement of respective coupling heads when they are engaged and detached each other between the fastener elements becomes smooth. Therefore, the slidability of the slider is remarkably improved, and the slider operation can be made very light.

According to the present invention, as described above, since a different structure is not used for the double structure and the single structure and the chain knitting structure that is not expandable is mainly adopted, elasticity of the fastener element attaching portion itself is very low. However, the elasticity peculiar to the knit fabric having respective stitches formed by connecting the needle loops via the sinker loop cannot be removed differently from a woven fabric.

Therefore, preferably, a warp in-laid yarn is inserted in a zigzag manner for each sinker loop of the base structure that is formed along at least one wale among the three or more wales (W11 to W13) including the fixing chain knitting yarn.

More preferably, a warp in-laid yarn is inserted in a zigzag manner between sinker loops, which are formed along at least one wale among the three or more wales (W11 to W13) including the fixing chain knitting yarn and are adjacent in a wale direction of the fixing chain knitting yarn fastening each leg portion (EL) of the continuous fastener element row (ER) while straddling the leg portion.

Further preferably, a warp in-laid yarn is inserted in a zigzag manner between sinker loops, which are formed along at least one wale among the three or more wales (W11 to W13) including the fixing chain knitting yarn and are adjacent in a wale direction of the base structure, and a warp in-laid yarn is inserted in a zigzag manner for each of needle loops, which are formed along at least one wale among the three or more wales (W11 to W13) including the fixing chain knitting yarn and are adjacent in a wale direction of the fixing chain knitting yarn fastening each leg portion (EL) of the continuous fastener element row (ER) while straddling the leg portion.

As a result, it is possible to effectively control an expansion degree in the longitudinal direction of the fastener tape main body and at the same time, the coupling strength can be made strong.

Preferably, the base structure of the fastener element attaching portion (EF) includes weft in-laid yarns.

Preferably, a fastener tape main body (TB) except for the fastener element attaching portion (EF) comprises a single structure composed of a tricot knitting yarn and a weft in-laid yarn.

Consequently, a thin fastener tape main body is formed and further, an even tape shape has been maintained for a long time while keeping flexibility as a knit fabric.

Preferably, an ear portion (A) composed of ground knitting yarns and the weft in-laid yarns is formed at a side edge of the fastener tape main body (TB) opposed to the fastener element attaching portion (EF).

Consequently, the expansion of the ear portion is made less so that a figuration is stable. The effects which the present invention exerts are considerably great.

DESCRIPTION OF THE PREFERRED EMBODIMENTS

Embodiments according to the present invention will be specifically described with reference to the examples below.

Figure 1:
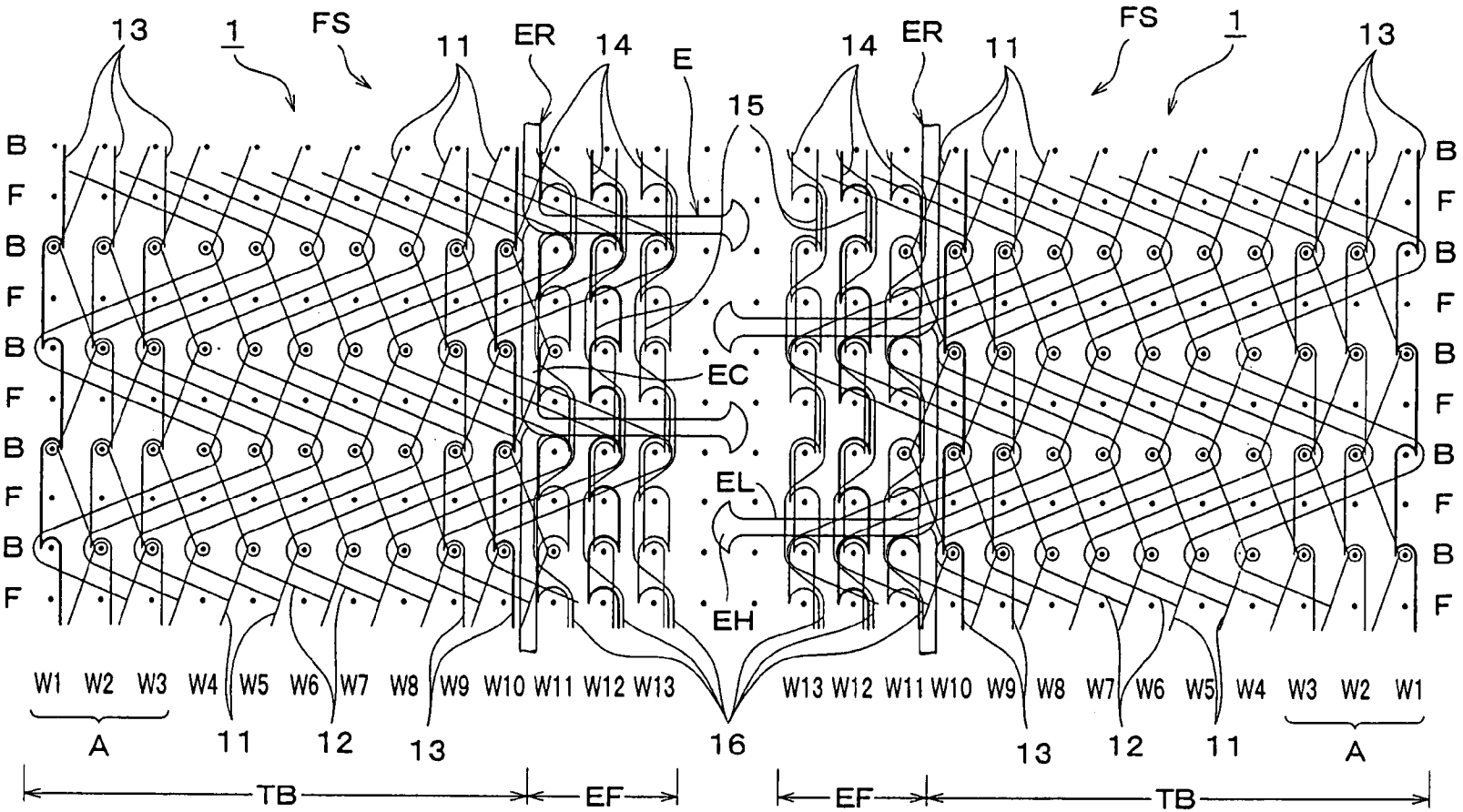
FIG. 1 is an entire knitting structure view of a knitted slide fastener showing a first embodiment according to the present invention.
Figure 2:
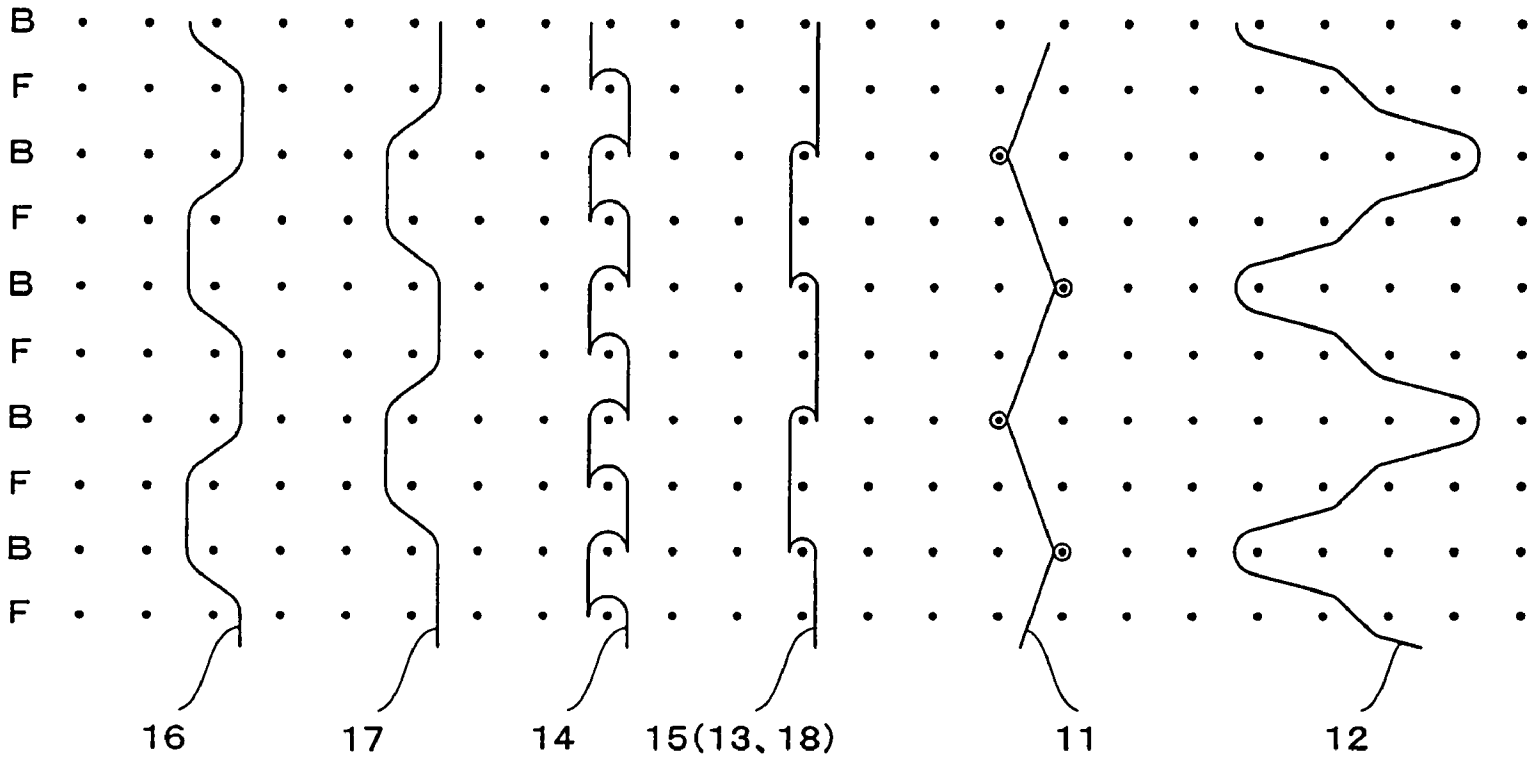
FIG. 2 is a structure view showing a knitting structure for each constitutional knitting yarn according to this embodiment.

FIG. 1 is a warp knitting structure view of an entire fastener chain of a slide fastener as a first embodiment according to the present invention, and FIG. 2 shows a knitting structure for each knitting yarn.

A fastener stringer FS of the knitted slide fastener of the present invention is organized by a warp knitting machine having two rows of needle beds such as a double Russell knitting machine. Note that, in the knitting structure views shown in FIGS. 1 and 2, on a needle position, a back needle (B) and a front needle (F) are arranged for each course. A fastener tape 10 according to the present embodiment is composed of a fastener tape main body TB configured by ten wales W1 to W10, and a fastener element attaching portion EF configured by three wales W11 to W13 on which a fastener element row ER is mounted, knitted, and fixed.

As shown in FIGS. 1 and 2, a base structure of the fastener tape main body TB is configured by a ground tricot knitting yarn 11 (2-2/2-0/2-2/2-4) of a single knitting structure by the back needle (B) and a weft in-laid yarn 12 (4-4/8-8/4-4/0-0) to be inserted in a zigzag manner over four wales of the fastener tape 10. In addition, according to the present embodiment, an ear portion A made of three wales W1 to W3 is formed at the side edge of the tape main body TB opposed to the fastener element attaching portion EF. Further, a ground chain knitting yarn 13 (0-0/0-2/2-2/2-0) of the single knitting structure by the back needle (B) is further added to this ear portion A and two wales W9 and W10 adjacent to the fastener element attaching portion EF of the fastener tape main body TB, and needle loops thereof are interlaced with respective needle loops of the tricot knitting yarn 11. According to the present embodiment, the ground chain knitting yarn 13 arranged at the furthest outside of the ear portion A and the ground chain knitting yarn 13 most adjacent to the fastener element attaching portion EF are made thicker than other ground chain knitting yarns 13. Note that, according to the present invention, it is not necessary to newly form the ear portion A, and the ear portion A may be a knitting structure as same as the fastener tape main body TB.

Incidentally, a polyester filament yarn of 220 decitex (T) is used for the thicker ground chain knitting yarns 13 arranged at the furthest outside of the ear portion A and most adjacent to the fastener element attaching portion EF. A polyester finished yarn of 167(T) is used for other ground chain knitting yarns 13 arranged at the ear portion A, the ground chain knitting yarn 13 adjacent second nearest to the element attaching portion EF, and the above-described ground tricot knitting yarn 11.

On the other hand, the areas of the three wales W11 to W13 to be formed at the other side edge of the fastener tape 1 compose the element attaching portion EF. This element attaching portion EF is configured by three fixing chain knitting yarns 14 (0-2/2-0/0-2/2-0) having the double knitting structure by a front needle (F) and a back needle (B); a ground chain knitting yarn 15 of the single knitting structure by the back needle (B) having the same knitting structure as the ground chain knitting yarn 13 of the ear portion A; a part of the ground tricot knitting yarn 11, and a part of the weft in-laid yarn 12.

According to the present embodiment, the yarn and the knitting structure are partially different in the first wale W13 arranged at the furthest outside of the element attaching portion EF and the second and third wales W12 and W13 arranged at the side of the tape main body TB in order. In other words, the single knitting structures by the back needle (B) of the first and second wales W1 and W2 are the same as the ground chain knitting yarn 15. However, they are different in that the single knitting structure by the back needle (B) of the third wale W3 is configured by the ground tricot knitting yarn 11, and the fixing chain knitting yarn 14 arranged at the second wale W2 is thicker than other fixing chain knitting yarns 14. On the other hand, in this element attaching portion EF, the fixing chain knitting yarn 14 of the double knitting structure, the ground chain knitting yarn 15, the ground tricot knitting yarn 11, and the weft in-laid yarn 12 are organized, and a mono filament made of a synthetic resin such as nylon and polyester forming the fastener element row ER shaped in a coil is knitted while changing its direction for each of four courses C, returning, and performing a reciprocating motion.

Figure 3:
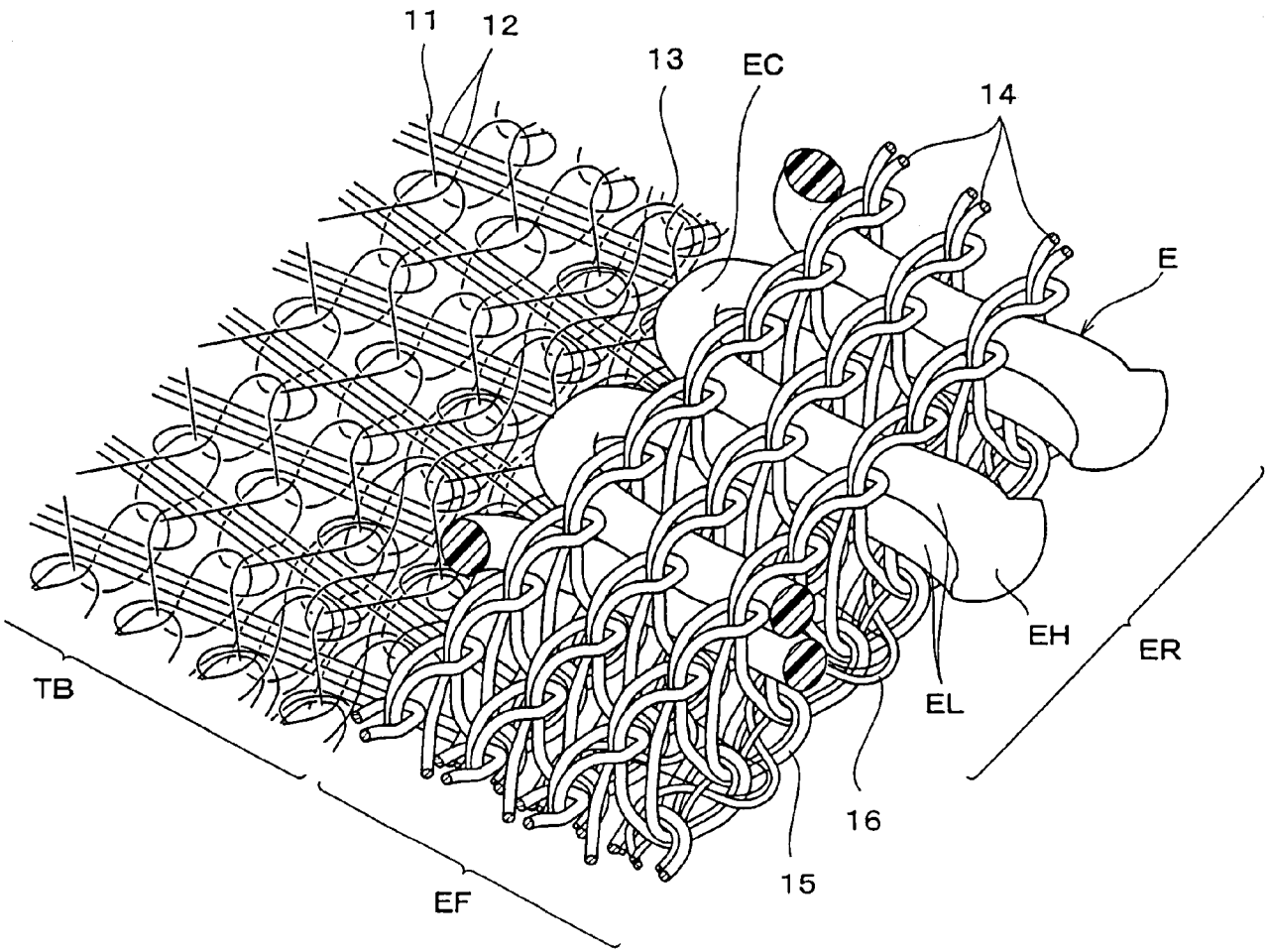
FIG. 3 is a patternal partially enlarged three-dimensional view of a stringer of the knitted slide fastener according to this embodiment seen from the side where a fastener element is fixed.

In order to fix each fastener element E by three fixing chain knitting yarns 14 of the double knitting structure by the front needle (F) and the back needle (B), as shown in FIGS. 1 and 3, upper and lower leg portions EL of each fastener element E are pressed by the needle loop of each fixing chain knitting yarn 14 that is formed by the front needle (F). At the same time, the needle loop formed by the back needle (B) is interlaced with the needle loop of the ground chain knitting yarn 15 of the single knitting structure that is also formed by the back needle (B), and then, the upper and lower leg portions EL of each fastener element E are sandwiched from the side by a sinker loop formed between respective needle loops that are formed by the front needle (F) and the back needle (B) of each fixing chain knitting yarn 14.

In other words, according to the present embodiment, on the upper surface of the coiled fastener element row ER to be knitted, the back needle (B) may form one needle loop of the fixing chain knitting yarn 14 by the double knitting structure on the upper surface of the upper and lower leg portions EL, and the other needle loop of the fixing chain knitting yarn 14 is interlace with the needle loop of the ground chain knitting yarn 15 of the front needle (F), and repeating this, a double chain stitch to mount and fix the coiled fastener element row ER is formed along a longitudinal direction of the element attaching portion EF. As a result, according to the present embodiment, the base knitting structure of the element attaching portion EF is organized as a more dense structure than the base knitting structure of the tape main body TB. Further, the base structure of the element attaching portion EF is configured by one of the double chain knitting yarns and the needle loop of the ground chain knitting yarn. Therefore, both of the upper and lower surfaces of the coiled fastener element row ER are made soft, the slidability of the slider is improved, and the base structure part having the fastener element row ER mounted thereon is made dense and thick, so that a further stable figuration can be obtained. Note that, in order to make FIGS. 1 and 3 more understandable, thickness of each knitting yard is changed and its stitch is shown while coming loose. However, each stitch is very dense in fact, and thickness in the knitting yarns does not submit to the illustrated examples.

In this case, in the mono filament made of a synthetic resin composing the coiled fastener element row ER, a portion corresponding to a coupling head portion EH and a connecting portion EC are made even by a stamping process in advance, and this portions are supplied between the front needle (F) and the back needle (B) of the warp knitting machine; the horizontal reciprocating motion is carried out; the even coupling head portion EH and connecting portion EC are folded so as to continuously form the coiled fastener element row ER. Note that, if the sectional shape of the monofilament requiring no stamping process is a rectangular or an ellipse, this monofilament may be horizontally inserted so as to form the coiled fastener element row without applying the stamping process.

In addition, according to the present embodiment, among three fixing chain knitting yarns 14 as a constitutional yarn of the double chain knitting structure, the fixing chain knitting yarn 14 to be arranged at a center including other fixing chain knitting yarns 14 is set to be thicker than other knitting yarns composing the fastener tape 10. Thereby, not only a stability of measurement can be made higher and attachment of yarns is made solid by making a tension of each fastener element E intense at a center part of the upper and lower leg portions EL, but also a fastening tension of the fixing chain knitting yarn at the side of the engagement head portion is lower than that of the center part of the upper and lower leg portions EL, so that the coupling head portion EH is moderately movable upon coupling and releasing the fastener element E and the coupling/releasing operation of the fastener element E with the slider can be performed smoothly.

Further, according to the present embodiment, as shown in FIG. 3, in the base structure of the element attaching portion EF, a warp in-laid yarn 16 is inserted along each wale of the first to third wales W13 to W11, respectively. Specifically, three warp in-laid yarns 16 are inserted in a zigzag manner, respectively, between the ground chain knitting stitches of the single structure adjacent in a wale direction of the first and second wales W13 and W12 formed by the front needle (F) and respective sinker loops of the ground tricot knitting yarn 11 of the single structure adjacent in a wale direction of the third wale W11. In these warp in-laid yarns 16, since the stitches are not formed by the front needle (F), even when forming other stitches by the front needle (F), an excess load by these warp in-laid yarns 16 is not given and there is no problem in high speed organization of the fastener tape by the double warp knitting machine. In addition, the stitches are not formed directly in this way, so that there is no elasticity in the warp in-laid yarn 16 itself. As a result, elasticity of the element attaching portion EF is further prevented, measurement in a length direction is made more stable, and tension of thrust, a lateral pulling tension, and slidability of the slider are further improved.

Incidentally, a polyester filament yarn is used for any of three fixing chain knitting yarns 14 arranged at this element attaching portion EF, and among these, a thickness of the center fixing chain knitting yarn 14 is thicker (namely, 334(T)) as compared to 278(T) of the fixing chain knitting yarns 14 at the opposite sides thereof. In addition, a polyester finished yarn is used for the other ground tricot knitting yarn 11 of the single knitting structure by the back needle (B) arranged at the element attaching portion EF and the weft in-laid yarn 12, and a polyester filament yarn is used for the ground chin knitting yarn 15 and the warp in-laid yarn 17, but the thickness thereof is defined as 167(T) in any case.

In addition, according to the present embodiment, as understandable from the above description, all needles of the back needle (B) and the front needle (F) only interlace two stitches, namely, a chain stitch and a chain stitch or a chain stitch and a tricot stitch with each other. This means that a load on each needle by the stitch is small, and at the same time, this means that the excess number of stitches are not formed in each needle. Therefore, a load on the entire knitting machine by the operation is made smaller, and a defect such as skip of a stitch can be remarkably reduced. Further, in a basic knitting structure of the base structure knitted and organized by the back needle (B) and the front needle (F), the number of the chain knitting structures and the tricot knitting structures and the kinds thereof are few, so that the operation of each needle is simplified and the operation of the knitting machine at a faster speed can be realized.

Figure 4:
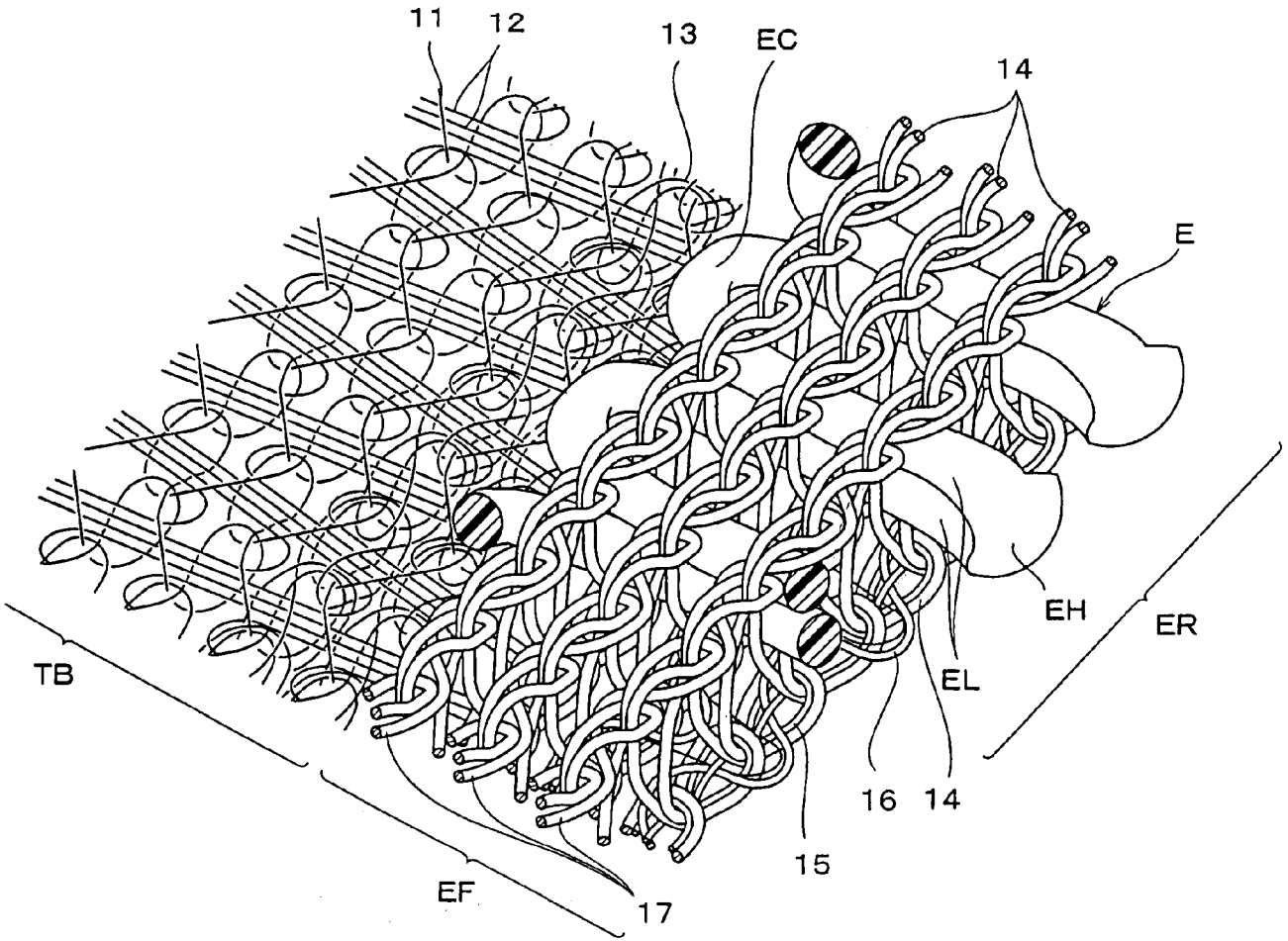
FIG. 4 is a patternal partially enlarged three-dimensional view of a modified example of this embodiment seen from the side where a fastener element is fixed.

FIG. 4 shows a modified example of the above-described first embodiment. According to this modified example, in addition to the warp in-laid yarn 16 to be inserted in the base structure, further, three warp in-laid yarns 17 are added along the fastener element row ER. In other words, along the first to third wale W13, W12, and W11 of the fastener element attaching portion EF, the warp in-laid yarns 17 are inserted in a zigzag manner, respectively, between the sinker loops, to which the chain stitches for fixture made of three fixing chain knitting yarns 14 organized by the front needle (F) of the double knitting structure and formed on the upper surfaces of the upper and lower leg portions EL of each fastener element E are adjacent. By adopting such a configuration, expansion in the length direction of the fastener element attaching portion EF can be strongly prevented. In addition to the stability of the figure of this fastener element attaching portion EF, the engagement tension of the fastener element E and lightness of the coupling/releasing of the fastener element E by the slider operation are further increased.

Figure 5:
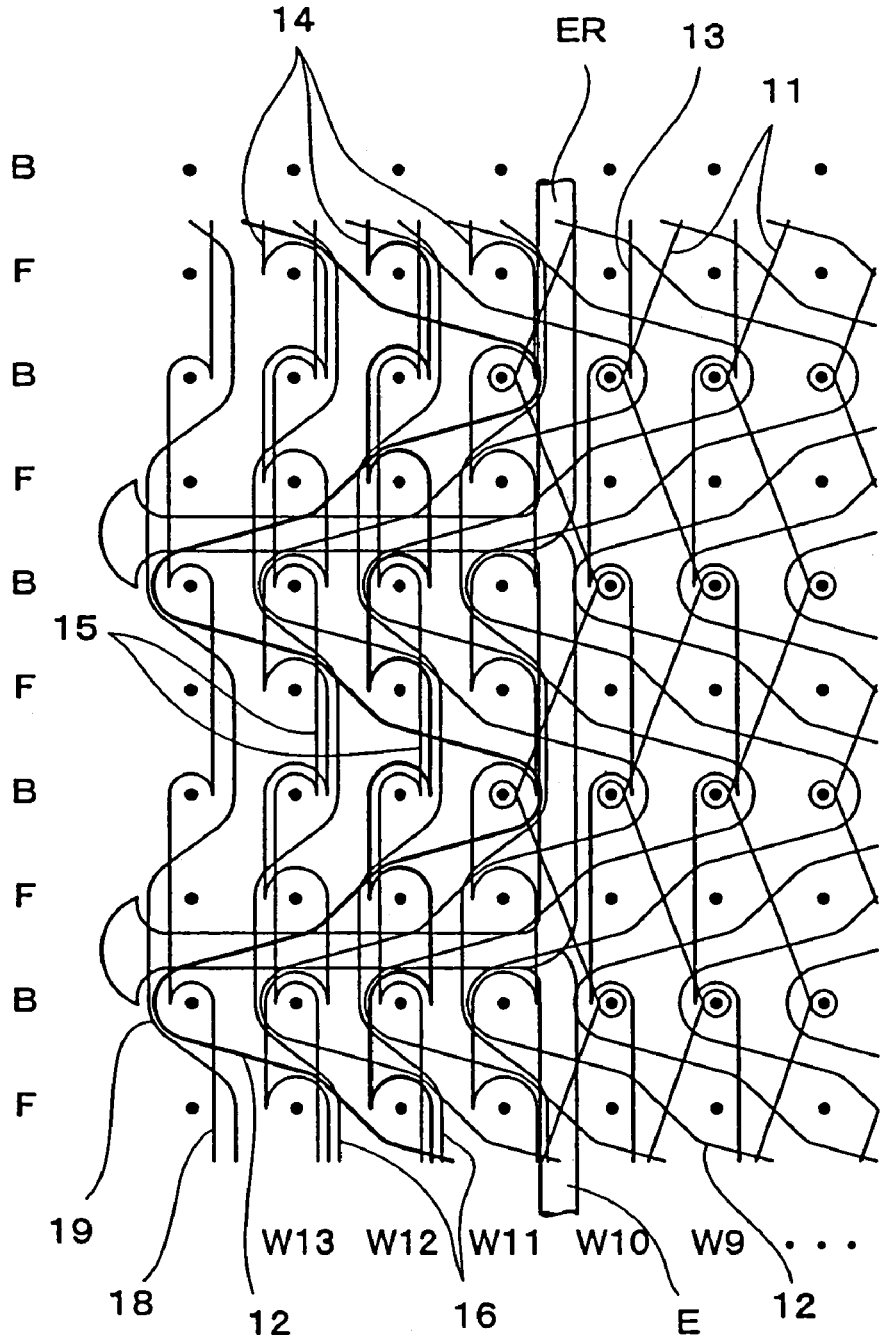
FIG. 5 is an entire knitting structure view of one stringer of a knitted slide fastener showing a second embodiment according to the present invention.
Figure 6:
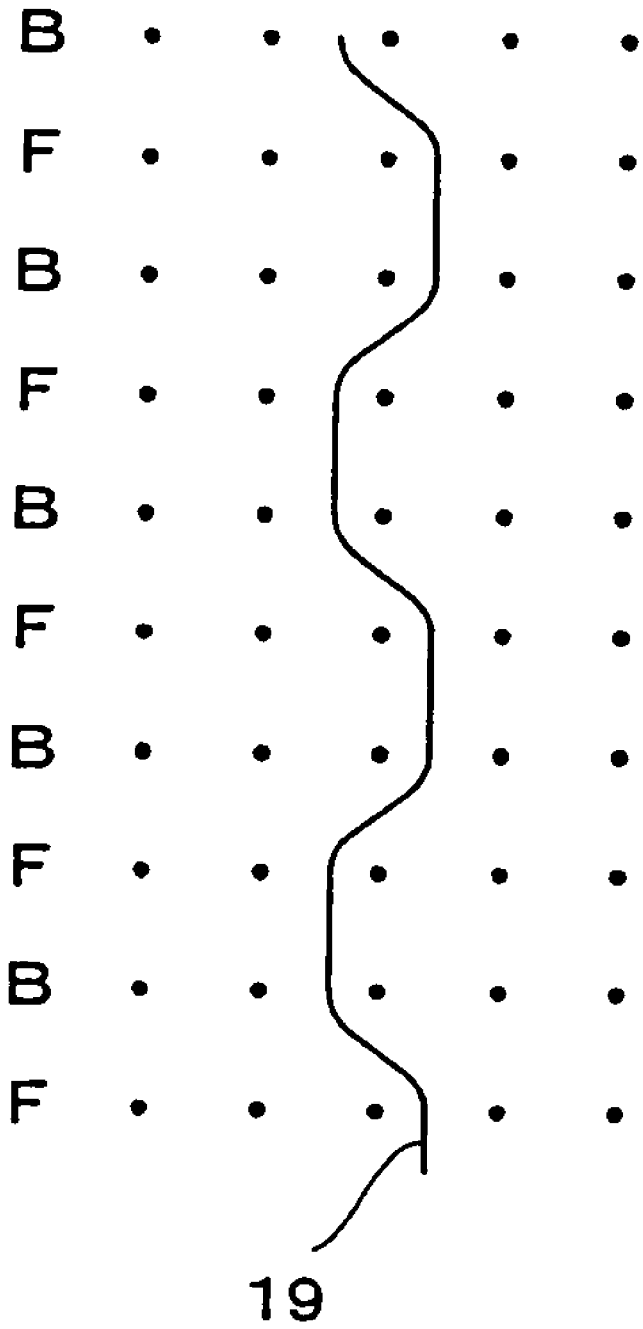
FIG. 6 is a structure view of a warp in-laid yarn that is arranged as an ear yarn of a fastener element attaching portion according to this second embodiment.

FIGS. 5 and 6 show a second embodiment according to the present invention. According to this embodiment, in addition to the knitting structure of the above-described first embodiment, an ear yarn 18 composed of the ground chain knitting structure (0-1/0-2/2-2/2-0) of the single structure by the back needle (B) is arranged along the external side end edge of the fastener element attaching portion EF, and a warp in-laid yarn 19 (0-0/2-2/2-2/0-0) is inserted between the sinker loops, to which the ear yarn 18 is adjacent. By adopting such a configuration, the figuration of the external side end edge of the fastener element attaching portion EF is stabilized.

Figure 7:
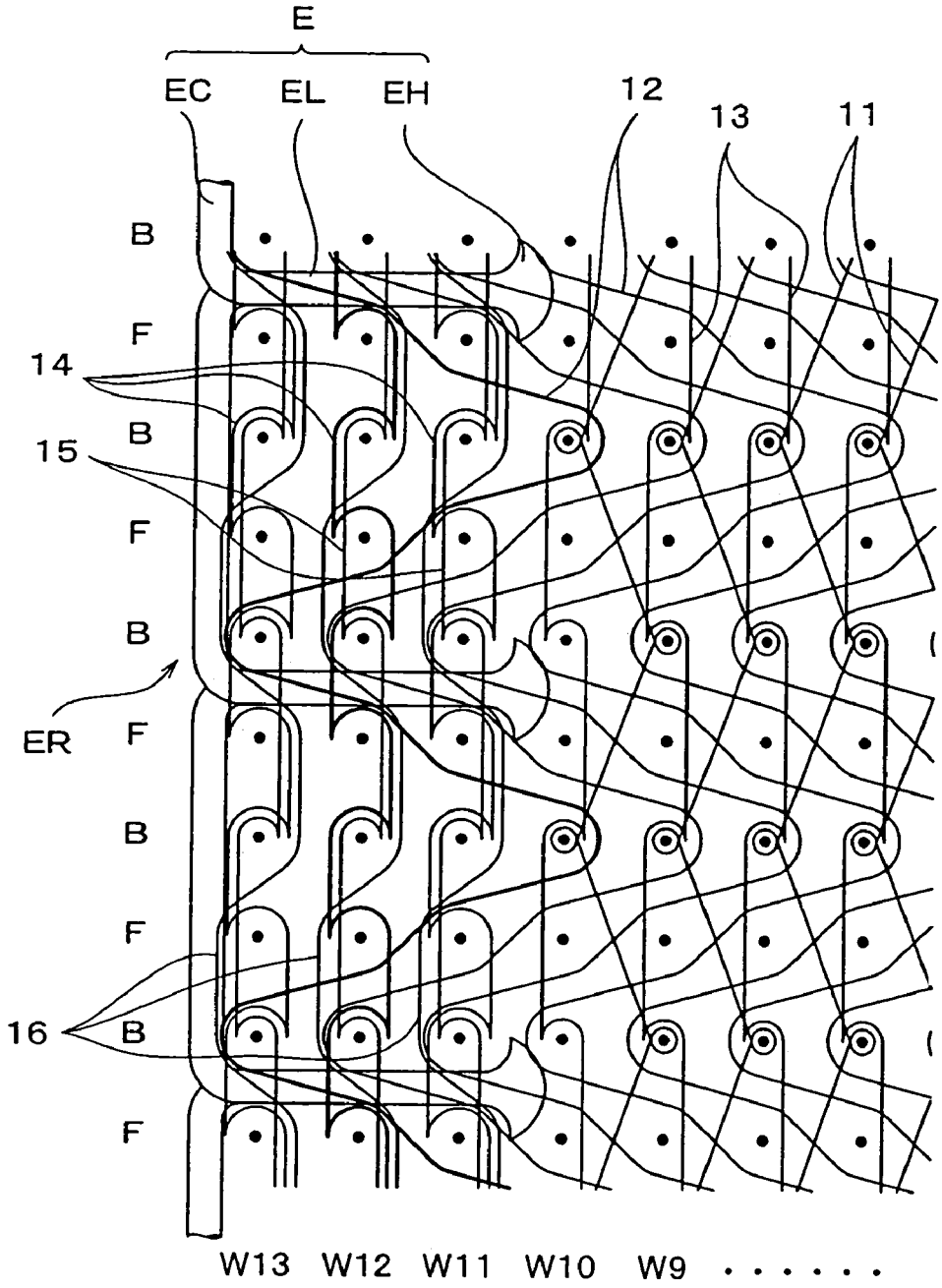
FIG. 7 is an entire knitting structure view of one stringer of a concealed knitted slide fastener showing a third embodiment according to the present invention.

FIG. 7 shows a third embodiment according to the present invention. Although the above-described first and second embodiments target a normal slide fastener, this embodiment illustrates an example of the concealed slide fastener. This embodiment is different from the above-described first embodiment in that a direction of the continuous fastener element row ER made of a mono filament which is folded for each four courses and is knitted in the fastener element attaching portion EF is reversed in this embodiment; and in this first embodiment, the base knitting structure of the third wale W11 of the fastener element attaching portion EF is composed of the ground tricot knitting yarn 11. However, in the present embodiment, in place of this tricot knitting yarn 11, it is composed of the ground chain knitting yarn 15 of the single structure by the back needle (B). Other configurations are the same as the first and second embodiments.

Upon organizing this knitted slide fastener, the mono filament is stamped to mold the coupling head portion EH, the connecting portion EC of each fastener element E that is molded in a coil is arranged at the external side end edge of the fastener element attaching portion EF. In addition, the coupling head EH is projected to the side of the fastener tape main body TB over the third wale W11 of the fastener element attaching portion EF to be sequentially knitted in the fastener element attaching portion EF. The fastener stringer FS that is organized in this way is folded to the rear side between the wale W11 at the third row from the external side end edge of the fastener element attaching portion EF and the fourth row of the wale W10 and heat setting is performed, and then, the folded figure is fixed.

This embodiment has also the same advantage and operation as the first embodiment. Additionally, the knitting structure of the fastener tape main body TB is entirely configured by the knitting structure of the ground tricot knitting yarn 11 and the ground chain knitting yarn, so that the fastener tape is made thickened. Further, the fastener stringer FS is folded to the rear side along the wale between the third row of the wale W11 and the fourth row of the wale W10 as described above, and the third row of the wale W11 arranged at the furthest outside is configured by the double structure in which respective needle loops of the fixing chain knitting yarn 14 and the ground chain knitting yarn 15 are interlaced with each other. Accordingly, the present embodiment has the same advantage and operation as the first and second embodiments, the figuration of this folded portion is stabilized, the figuration of the fastener stringer FS itself is stabilized. Moreover, when the concealed slide fastener according to the present embodiment is applied to a body applied to such as a cloth, it is possible to apply the figuration of the applying end edge of this concealed slide fastener to the body in a stable condition.

In addition, according to the present embodiment, for the weft in-laid yarn 12 inserted in a course direction while reciprocating, particularly, between the first wale 13 arranged at the external side end edge of the fastener element attaching portion EF and the fourth wale W10, a yarn thicker than other weft in-laid yarns 12 is used. Incidentally, a thickness of the weft in-laid yarn 12 reciprocating at the first wale 13 arranged at the external side end edge of the fastener element attaching portion EF is defined as 220(T) and a thickness of other weft in-laid yarns 12 is defined as 167(T). By arranging this thick weft in-laid yarn 12, it is possible to stabilize a measurement in a width direction of the fastener element attaching portion EF. Note that, also with respect to the first and second embodiments, as same as the present embodiment, for the weft in-laid yarn 12 inserted in a course direction while reciprocating between the first wale 13 arranged at the external side end edge of the fastener element attaching portion EF and the fourth wale W10, a yarn thicker than other weft in-laid yarns 12 may be used.

Figure 8:
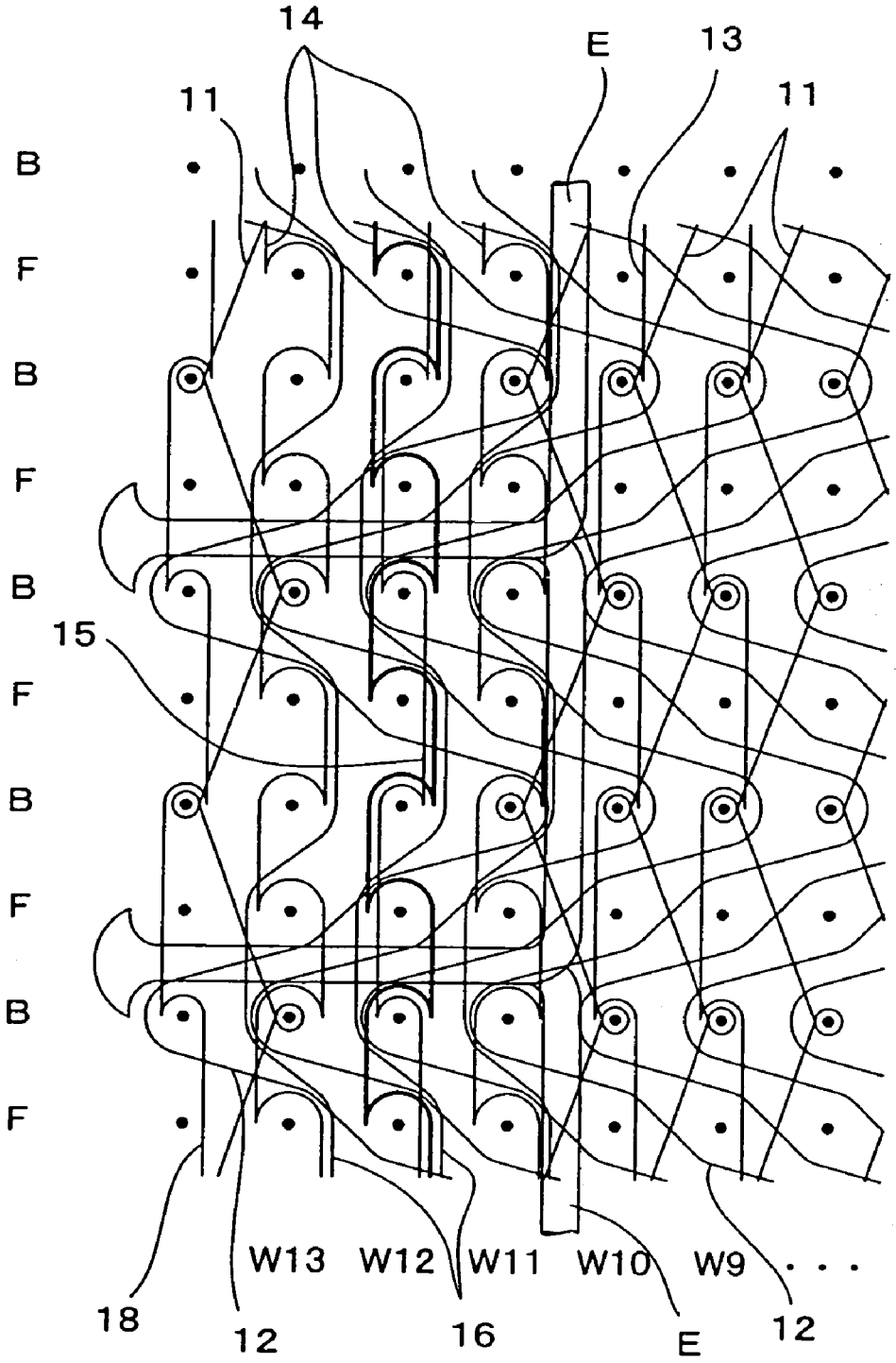
FIG. 8 is an entire knitting structure view of one stringer of a knitted slide fastener showing a fourth embodiment according to the present invention.

FIG. 8 shows a forth embodiment according to the present invention. According to this embodiment, the yarn and the knitting structure are partially different in the first wale W13 arranged at the furthest outside of the element attaching portion EF and the second and third wales W12 and W11 arranged at the side of the tape main body TB in order.

In other words, the single knitting structure by the back needle (B) of the second wale W12 is the same as the ground chain knitting yarn 15. However, they are different in that the single knitting structure by the back needle (B) of the first and third wales W13 and W11 is configured by the ground tricot knitting yarn 11, and the fixing chain knitting yarn 14 arranged at the second wale W2 is thicker than other fixing chain knitting yarns 14, which is the same as the first embodiment.

Also, according to the present embodiment, as shown in FIG. 8, in the base structure of the element attaching portion EF, a warp in-laid yarn 16 is inserted along each wale of the first to third wales W13 to W11, respectively.

Further, an ear yarn 18 composed of the ground chain knitting structure (0-0/0-2/2-2/2-0) of the single structure by the back needle (B) is arranged along the external side end edge of the fastener element attaching portion EF, and the needle loop is configured by the ground tricot knitting yarn 11 composing the base structure of the first wale W13 and the ear yarn 18 composed of the ground chain knitting structure by the back needle (B).

It is also permissible that the warp in-laid yarn 19 (0-0/0-2/2-2/2-0) is inserted between the sinker loops adjacent to the ear yarn 18 in a zigzag manner.

In this way, by configuring the needle loop of the ground tricot knitting yarn 11 in the base structure of the ear yarn 18, the strength of the wale including the ear yarn 18 is increased.

What is claimed is:

1. A knitted slide fastener having a base structure composed of a double structure of a warp knitting, in which a continuous fastener element row (ER) is knitted in a fastener element attaching portion (EF) formed at one side edge portion of a fastener tape at the same time of organization of the fastener tape, wherein:

three or more fixing chain knitting yarns are knitted in the fastener element attaching portion (EF) as a constitutional knitting yarn of the double structure;

a needle loop at a part of each of the fixing chain knitting yarns presses a leg portion of each fastener element (E) while straddling the leg portion; a needle loop other than the needle loop is interlaced with a needle loop of a ground knitting yarn composing a part of the base structure on which the continuous fastener element row (ER) is mounted;

at least a part of the base structure composing respective wales (W11 to W13) of the fastener element attaching portion (EF) includes a ground chain knitting yarn composed of a single structure; and a partial needle loop of the fixing chain knitting yarn composes a double base structure while being interlaced only with the needle loop of the ground chain knitting yarn of the second wale (W12), the partial needle loop of the fixing chain knitting yarn being formed on at least the second wale (W12) adjacent to the inside of the first wale (W13) including the fixing chain knitting yarn that is arranged at the furthest external side of the fastener element attaching portion (EF) among the three or more fixing chain knitting yarns.

2. The knitted slide fastener according to claim 1, wherein the fixing chain knitting yarn of the second wale (W12) is composed of a knitting yarn that is thicker than the other fixing chain knitting yarns.

3. The knitted slide fastener according to claim 1 or 2, wherein a warp in-laid yarn is inserted in a zigzag manner for each sinker loop of the base structure that is formed along at least one wale among the three or more wales (W11 to W13) including the fixing chain knitting yarn.

4. The knitted slide fastener according to claim 1 or 2, wherein a warp in-laid yarn is inserted in a zigzag manner between sinker loops, which are formed along at least one wale among the three or more wales (W11 to W13) including the fixing chain knitting yarn and are adjacent in a wale direction of the fixing chain knitting yarn fastening each leg portion (EL) of the continuous fastener element row (ER) while straddling the leg portion.

5. The knitted slide fastener according to claim 1 or 2, wherein a warp in-laid yarn is inserted in a zigzag manner between sinker loops adjacent in a wale direction of the base structure formed along at least one wale among the three or more wales (W11 to W13) including the fixing chain knitting yarn, and a warp in-laid yarn is inserted in a zigzag manner for each of needle loops, which are formed along at least one wale among the three or more wales (W11 to W13) including the fixing chain knitting yarn and are adjacent in a wale direction of the fixing chain knitting yarn fastening each leg portion (EL) of the continuous fastener element row (ER) while straddling the leg portion.

6. The knitted slide fastener according to claim 1 or 2, wherein the base structure of the fastener element attaching portion (EF) includes weft in-laid yarns.

7. The knitted slide fastener according to claim 1 or 2, wherein a fastener tape main body (TB) except for the fastener element attaching portion (EF) comprises a single structure composed of a tricot knitting yarn and a weft in-laid yarn.

8. The knitted slide fastener according to claim 7, wherein an ear portion (A) composed of ground knitting yarns and the weft in-laid yarns is formed at a side edge of the fastener tape main body (TB) opposed to the fastener element attaching portion (EF).

* * * * *